US005553999A

United States Patent [19]

Proctor et al.

[11] Patent Number: 5,553,999

[45] Date of Patent: Sep. 10, 1996

[54] SEALABLE TURBINE SHROUD HANGER

[75] Inventors: Robert Proctor, West Chester; David R. Linger, Cincinnati; David A. Di Salle, West Chester; Steven R. Brassfield, Cincinnati; Larry W. Plemmons, Fairfield, all of Ohio

[73] Assignee: General Electric Company, Cincinnati, Ohio

[21] Appl. No.: 467,437

[22] Filed: Jun. 6, 1995

[51] Int. Cl.[6] ..... F01D 11/18

[52] U.S. Cl. ..... 415/173.1; 415/134; 415/139

[58] Field of Search ..... 415/173.1, 173.3, 415/115, 134, 138, 139

[56] References Cited

U.S. PATENT DOCUMENTS

| | | | |
|---|---|---|---|
| 3,860,358 | 1/1975 | Cavicchi et al. | 415/173.1 |
| 4,101,242 | 7/1978 | Coplin et al. | 415/134 |
| 4,303,371 | 12/1981 | Eckert . | |
| 4,573,866 | 3/1986 | Sandy, Jr. et al. . | |
| 5,022,816 | 6/1991 | Maier et al. | 415/115 |
| 5,169,287 | 12/1992 | Proctor et al. . | |
| 5,174,714 | 12/1992 | Plemmons et al. . | |
| 5,188,506 | 2/1993 | Creevy et al. | 415/173.1 |
| 5,197,853 | 3/1993 | Creevy et al. | 415/173.1 |
| 5,205,708 | 4/1993 | Plemmons et al. | 415/173.1 |

OTHER PUBLICATIONS

General Electric Company, CF34–3A1 gas turbine engine in production more than 1 year; 3 figures showing high pressure turbine shrouds and unpublished proposed temporary fix.

*Primary Examiner*—Edward K. Look
*Assistant Examiner*—Michael S. Lee
*Attorney, Agent, or Firm*—Andrew C. Hess; Wayne O. Traynham

[57] ABSTRACT

A turbine shroud hanger includes forward and aft radially outer hooks for mounting the hanger to an annular shroud support, and forward and aft radially inner hooks for supporting a shroud panel radially above a plurality of turbine rotor blades for controlling tip clearance therebetween. The hanger forward outer hook has a radially outer land defined by a pair of pads at distal ends of the hook, with a ridge extending circumferentially therebetween. The outer land is interrupted by a central recess extending between the pads and aft from the ridge to a distal edge of the hook. The forward outer hook has a predetermined radial height which is predeterminedly larger than the radial height of the corresponding forward slot in the shroud support for effecting an interference fit at least in part at the pair of pads to provide a seal against leakage of bleed air.

8 Claims, 4 Drawing Sheets

SEALABLE TURBINE SHROUD HANGER

CROSS REFERENCE TO RELATED APPLICATION

The present invention is related to concurrently filed application Ser. No. 08/487,426, filed Jun. 6, 1995, entitled "Controlled Leakage Shroud Panel" (Docket 13DV-12212).

BACKGROUND OF THE INVENTION

The present invention relates generally to gas turbine engines, and, more specifically, to clearance control between turbine rotor blade tips and a stator shroud spaced radially thereabove.

A gas turbine engine includes in serial flow communication one or more compressors followed in turn by a combustor and high and low pressure turbines disposed axisymmetrically about a longitudinal axial centerline within an annular outer casing. During operation, the compressors are driven by the turbine and compress air which is mixed with fuel and ignited in the combustor for generating hot combustion gases. The combustion gases flow downstream through the high and low pressure turbines which extract energy therefrom for driving the compressors and producing output power either as shaft power or thrust for powering an aircraft in flight, for example.

Each of the turbines includes one or more stages of rotor blades extending radially outwardly from respective rotor disks, with the blade tips being disposed closely adjacent to a turbine shroud supported from the casing. The tip clearance defined between the shroud and blade tips should be made as small as possible since the combustion gases flowing therethrough bypass the turbine blades and therefore provide no useful work. In practice, however, the tip clearance is typically sized larger than desirable since the rotor blades and turbine shroud expand and contract at different rates during the various operating modes of the engine.

The turbine shroud has substantially less mass than that of the rotor blades and disk and therefore responds at a greater rate of expansion and contraction due to temperature differences experienced during operation. Since the turbines are bathed in hot combustion gases during operation, they are typically cooled using compressor bleed air suitably channeled thereto. In an aircraft gas turbine engine for example, acceleration burst of the engine during takeoff provides compressor bleed air which is actually hotter than the metal temperature of the turbine shroud. Accordingly, the turbine shroud grows radially outwardly at a faster rate than that of the turbine blades which increases the tip clearance and in turn decreases engine efficiency. During a deceleration chop of the engine, the opposite occurs with the turbine shroud receiving compressor bleed air which is cooler than its metal temperature causing the turbine shroud to contract relatively quickly as compared to the turbine blades, which reduces the tip clearance.

Accordingly, the tip clearance is typically sized to ensure a minimum tip clearance during deceleration, for example, for preventing or reducing the likelihood of undesirable rubbing of the blade tips against the turbine shrouds.

The turbine shroud therefore directly affects overall efficiency or performance of the gas turbine engine due to the size of the tip clearance. The turbine shroud additionally affects performance of the engine since any compressor bleed air used for cooling the turbine shroud is therefore not used during the combustion process or the work expansion process by the turbine blades and is unavailable for producing useful work. Accordingly, it is desirable to reduce the amount of bleed air used in cooling the turbine shroud for maximizing the overall efficiency of the engine.

In order to better control turbine blade tip clearances, active clearance control systems are known in the art and are relatively complex for varying during operation the amount of compressor bleed air channeled to the turbine shroud. In this way the bleed air may be provided as required for minimizing the tip clearances, and the amount of bleed air may therefore be reduced. However, in order to minimize the complexity and cost of providing clearance control, typical turbine shrouds are unregulated in cooling the various components thereof.

In one turbine shroud arrangement, a row of arcuate shroud panels is supported from a row of shroud hangers which in turn is supported from an annular shroud support or ring joined to an outer casing. The several joints between these components are-typically axially engaging hooks. Since compressor bleed air is suitably channeled through the turbine shroud components for cooling thereof, the thermal response of the turbine shroud is dependent on the heat transfer through the various components and hooks thereof. For example, the hanger has a forward outer hook which axially engages a complementary forward slot of the shroud support. Necessary manufacturing tolerances between the hook and slot necessarily results in bleed air leakage therethrough during operation. In one prior art configuration, the outer surface of this hanger forward hook has a plurality of circumferentially spaced apart protruding dimples formed by indentations from the inner surface which allow the hanger to be assembled to the shroud support with an interference fit between the dimples and the forward slot walls. However, leakage of the bleed air between the dimples and around the forward hook still occurs which undesirably increases the thermal response time of the turbine shroud in this region.

SUMMARY OF THE INVENTION

A turbine shroud hanger includes forward and aft radially outer hooks for mounting the hanger to an annular shroud support, and forward and aft radially inner hooks for supporting a shroud panel radially above a plurality of turbine rotor blades for controlling tip clearance therebetween. The hanger forward outer hook has a radially outer land defined by a pair of pads at distal ends of the hook, with a ridge extending circumferentially therebetween. The outer land is interrupted by a central recess extending between the pads and aft from the ridge to a distal edge of the hook. The forward outer hook has a predetermined radial height which is predeterminedly larger than the radial height of the corresponding forward slot in the shroud support for effecting an interference fit at least in part at the pair of pads to provide a seal against leakage of bleed air.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT

Figure 1:
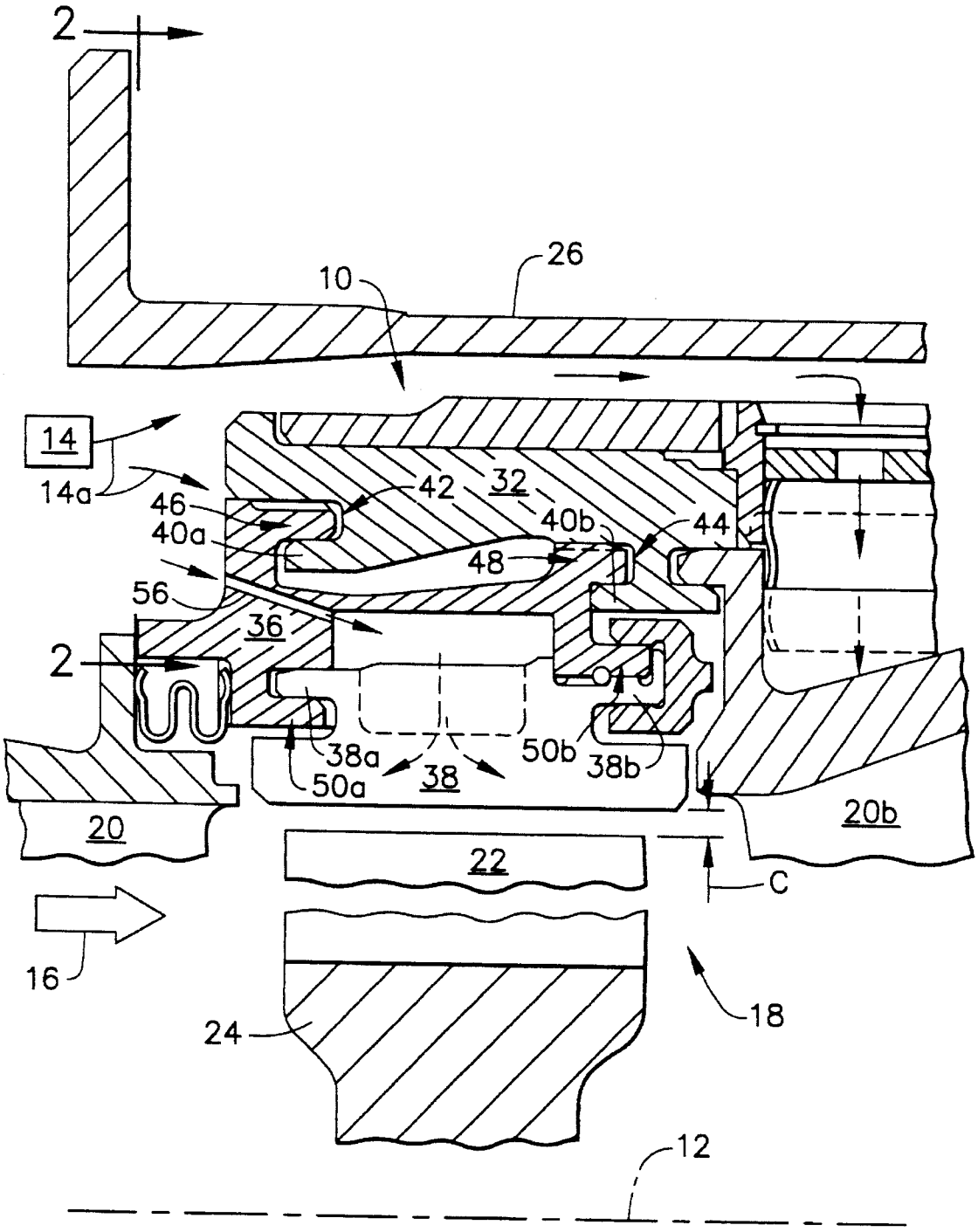
FIG. 1 is a partly sectional axial view through a portion of an axisymmetrical turbine shroud including a hanger in accordance with one embodiment of the present invention which supports shroud panels radially above a row of turbine rotor blades extending outwardly from a rotor disk.

Illustrated in FIG. 1 is an exemplary embodiment of a first stage turbine shroud 10 which is axisymmetrical about an axial centerline axis 12 in an aircraft gas turbine engine. The aircraft engine also includes one or more conventional compressors one of which is represented schematically by the box 14, with compressed air being channeled to a conventional combustor (not shown) in which the air is mixed with fuel and ignited for generating hot combustion gases 16 which are discharged axially therefrom.

Disposed downstream from the combustor is a conventional high pressure turbine (HPT) 18 which receives the combustion gases 16 for extracting energy therefrom. In this exemplary embodiment, the HPT 18 includes at least two stages, with the second stage not being illustrated, and portions of the first stage being illustrated in FIG. 1. The first stage includes a conventional first stage stationary turbine nozzle 20 having a plurality of circumferentially spaced apart stator vanes extending radially between outer and inner annular bands. Disposed downstream from the nozzle 20 are a plurality of circumferentially spaced apart first stage turbine rotor blades 22 extending radially outwardly from a first stage rotor disk 24 axisymmetrically around the centerline axis 12.

Figure 2:
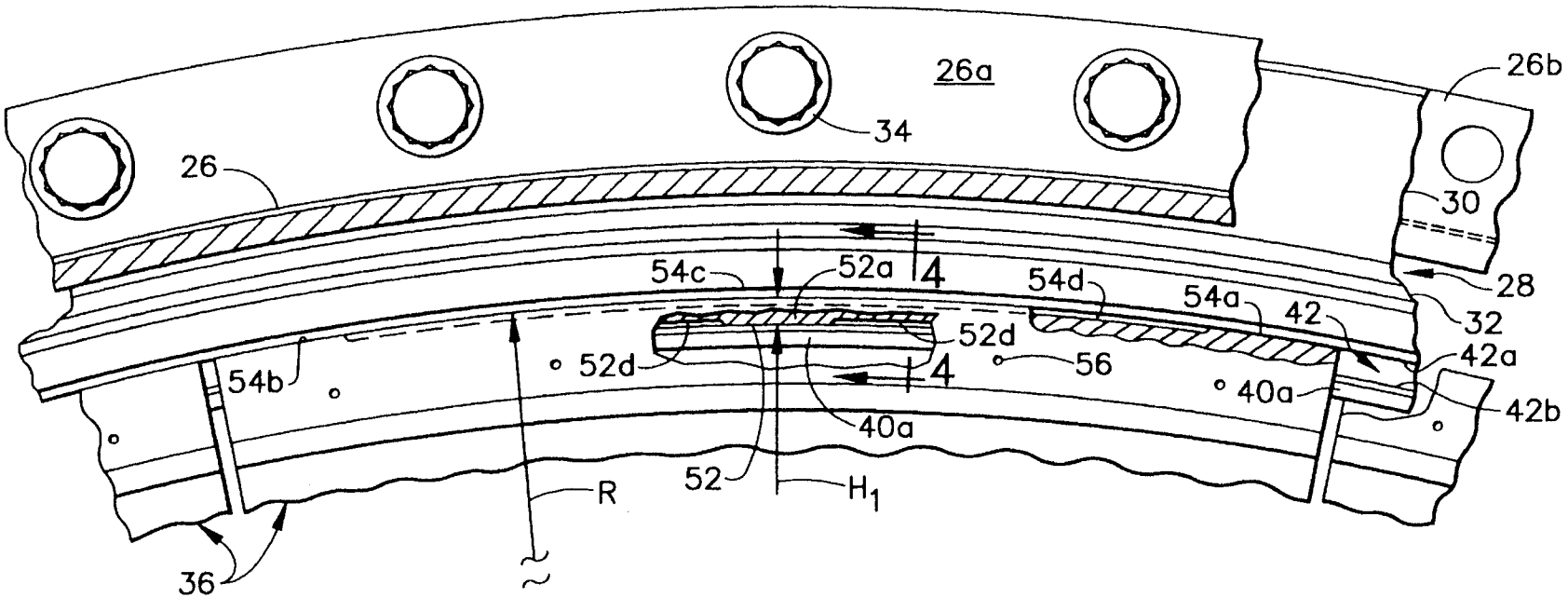
FIG. 2 is a forward-looking-aft view of a portion of the turbine shroud illustrated in FIG. 1 and taken along line 2—2.

The turbine shroud 10 illustrated in FIG. 1 is an assembly including a corresponding portion of an annular outer stator casing 26 which provides a stationary support for the several components thereof. As shown in FIG. 2, the outer casing 26 is axially split at a pair of adjacent first and second radial flanges 26*a* and 26*b* which complement each other and are formed as respective integral ends of the casing 26 at the splitline. An annular, one-piece shroud ring or support 28 is suspended from the casing first and second flanges 26*a,b*. The shroud support 28 is generally L-shaped In transverse section and has an annular radial support flange 30 at a proximal end and an integral annular forward support leg 32 which extends axially forwardly from a radially inner end of the support flange 30. The radial flange 30 is conventionally secured to the casing flanges 26*a,b* by a plurality of bolts 34 and cooperating nuts. The first stage turbine shroud 10 is supported by the forward distal end of the forward support leg 32, with the support leg 32 additionally supporting the second stage turbine nozzle 20*b* (a portion of which is shown in FIG. 1) and a second stage turbine shroud (not shown) which are not the subject of the present invention.

As shown in FIGS. 1 and 2, a plurality of circumferentially adjoining arcuate turbine shroud hangers 36 are sealingly joined to the forward leg 32 of the shroud support 28 in accordance with one embodiment of the present invention. The hangers 36 in turn support a plurality of circumferentially adjoining arcuate shroud panels 38 radially above the tips of the rotor blades 22 for defining a tip clearance C therebetween. Transient thermal response performance of the turbine shroud 10 affects the tip clearance C, and it is desired to minimize variations in the size of the tip clearance C for improving performance of the HPT 18 and in turn performance of the aircraft engine.

As shown in FIG. 1, the forward distal end of the forward leg 32 of the shroud support 28 includes a pair of axially spaced apart forward and aft hooks 40*a* and 40*b* which extend axially forward. The forward and aft hooks 40*a,b* are conventionally configured and define a respective pair of conventional forward and aft slots 42 and 44 which open in the axially forward direction.

Figure 3:
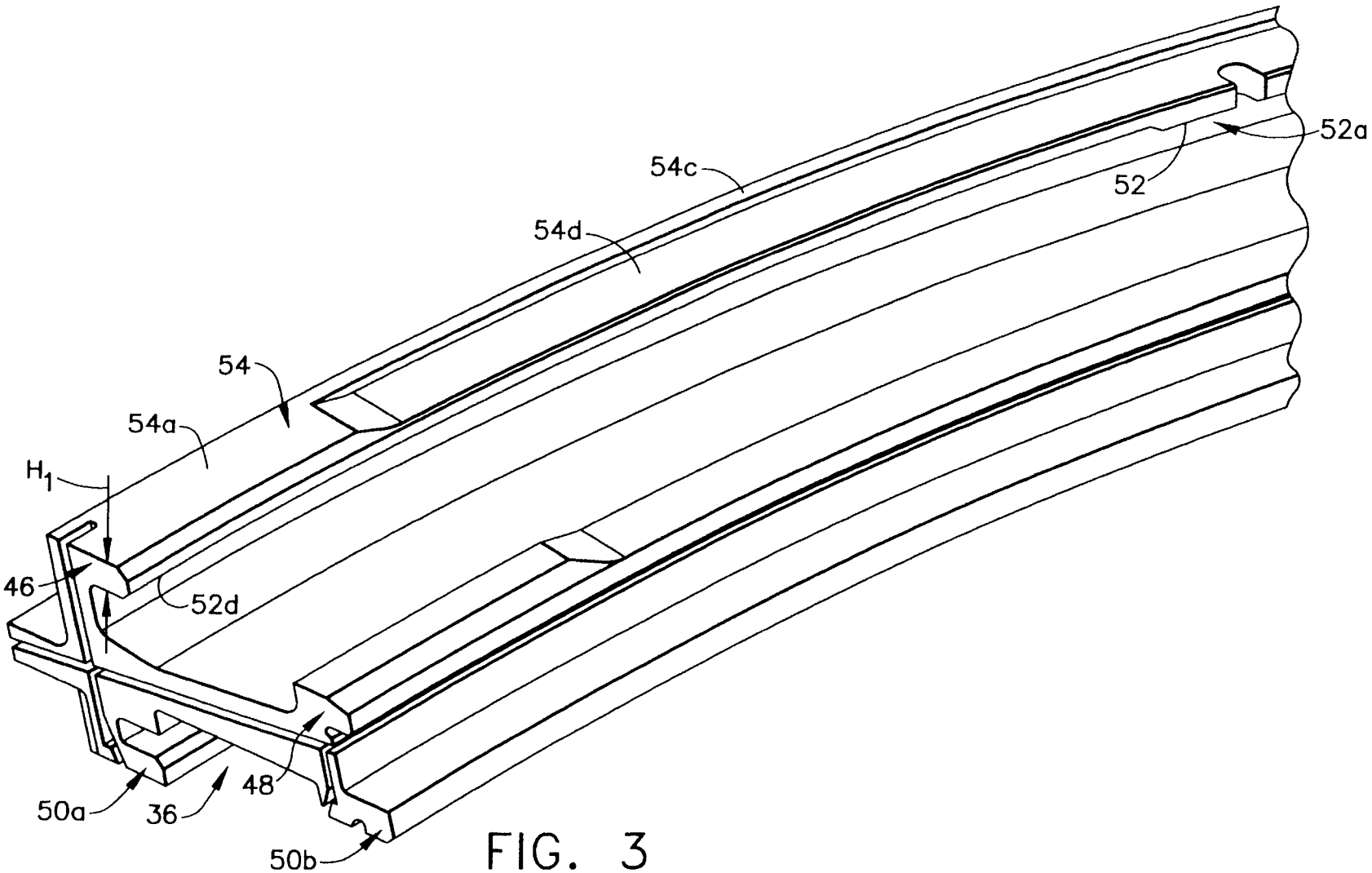
FIG. 3 is an aft-looking-forward perspective view of a portion of the hanger illustrated in FIGS. 1 and 2 removed from the shroud assembly.

As shown in FIGS. 1 and 3, each of the shroud hangers 36 includes forward and aft radially outer hooks 46 and 48 which extend axially aft and are configured for axially slidingly engaging during assembly the respective forward and aft slots 42, 44 of the forward leg 32 of the shroud support 28. Each of the hangers 36 also includes forward and aft radially inner hooks 50*a* and 50*b* which extend axially aft and are conventionally configured for engaging or supporting respective forward and aft hooks 38*a* and 38*b* of the shroud panels 38 for supporting the panels 38 above the blades 22 as shown in FIG. 1. Except for the sealed joint provided between the hanger forward outer hook 46 and its cooperating shroud support forward slot 42 and forward hook 40*a*, the configurations of the shroud panels 38, hangers 36, and shroud support forward leg 32 are otherwise conventional.

Figure 4:
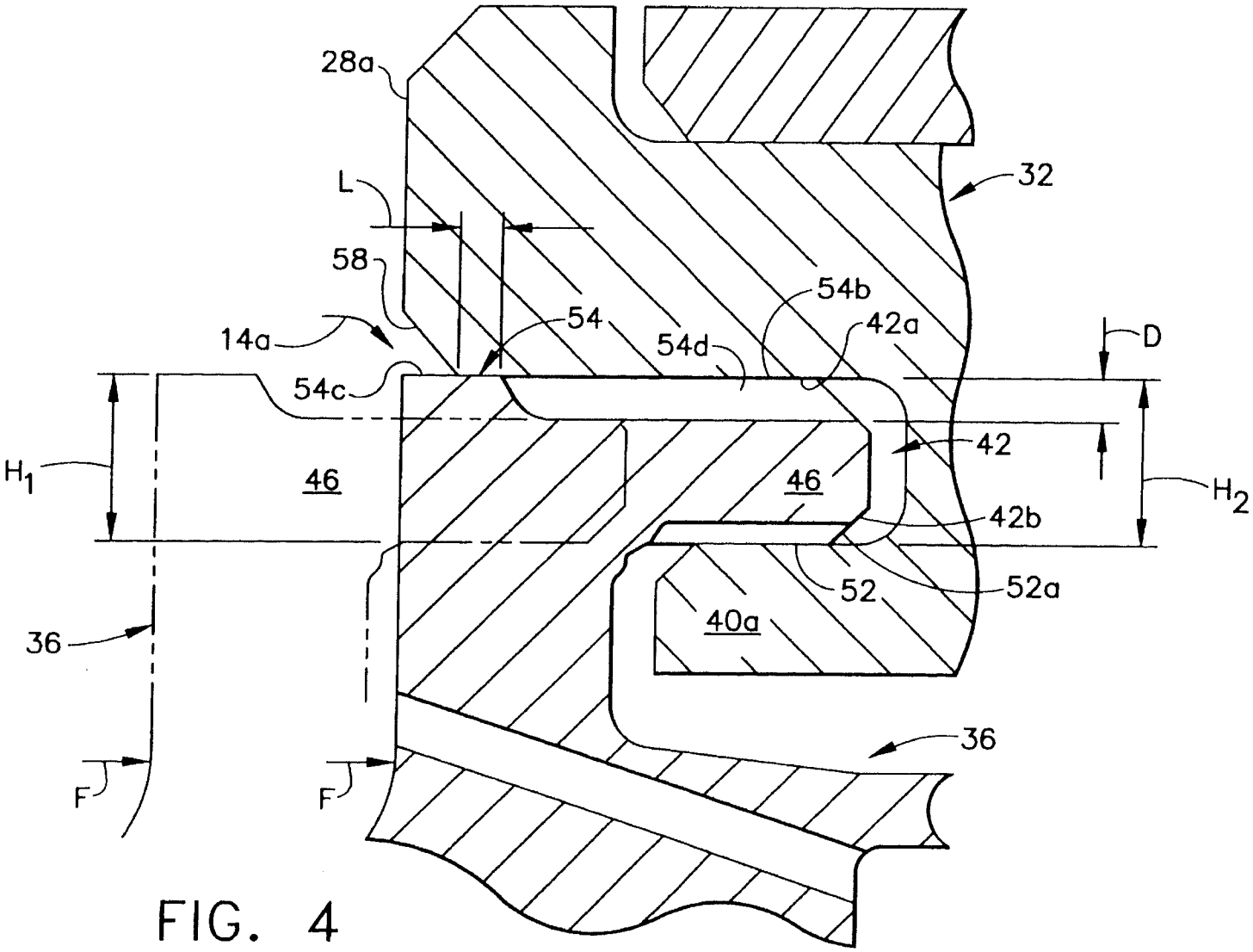
FIG. 4 is an enlarged axial sectional view through the forward outer hook of the hanger illustrated in FIGS. 1–3 assembled into its cooperating forward slot of the shroud support, and taken along line 4—4 of FIG. 2.

As shown in FIG. 1, and in more particularity in FIG. 4, each of the hangers 36 is assembled to the shroud support forward leg 32 by axial translation which engages the hanger forward and outer hooks 46, 48 into the respective forward and aft slots 42, 44 defined by the shroud support forward and aft hooks 40*a,b*. In this way, the hangers 36 are securely mounted to the shroud support 28.

As shown in FIGS. 3 and 4, the hanger forward outer hook 46 has a radially inner land 52 and a radially outer land 54 between which is defined the outer configuration of the forward outer hook 46. In accordance with the present invention, the outer land 54 is defined by a pair of uniform or smooth outer pads 54*a*, 54*b* (see also FIG. 2) which extend circumferentially inwardly towards each other from opposite circumferential distal ends of the forward outer hook 46. The outer land 54 also includes a portion which is a bump or ridge 54*c* extending circumferentially between the pads 54*a,b*, integrally therewith, and extends along the forward edge of the forward outer hook 46. The outer land 54 is interrupted by a central recess 54*d* extending circumferentially between the pads 54*a,b*, and extends also fully aft from the ridge 54*c* to the distal or aft edge of the forward outer hook 46.

The inner land 52 is preferably defined by a central inner pad 52*a* disposed circumferentially between a pair of recesses 52*d*. The central pad 52*a* is similar to the outer land pads 54*a*, 54*b* except that it extends in a radially opposite direction to effect an interference fit in the shroud support forward slot 42.

As shown in FIGS. 3 and 4, the forward outer hook 46 has a predetermined radial height $H_1$ measured radially between the inner and outer lands 52, 54 thereof which is predeterminedly greater than a predetermined radial height $H_2$ (see FIG. 4) of the shroud support forward slot 42 so that the forward outer hook 46 may be axially inserted into the forward slot 42 in an interference fit therein at least in part at the pair of interference pads 54*a,b* to provide a discourager seal thereat against leakage of bleed air 14*a* conventionally channeled to the turbine shroud 10 from the compressor 14 illustrated in FIG. 1. The difference in the undistorted radial height $H_1$ of the forward outer hook 46 and the radial height $H_2$ of the shroud support forward slot 42 may have any suitable value subject to manufacturing tolerances for effecting the interference fit. With present day improved manufacturing equipment, the difference in radial height $H_1$ and $H_2$ may be up to about 5 mils (0.127 mm).

The hanger 36 is conventionally pressed axially into the shroud support 28 by a suitable axial force F to effect the interference fit between the forward hook 46 and the forward slot 42 at the three pads 52*a*, 54*a*, and 54*b*. Since the inner pad 52*a* is disposed centrally between the outer pads 54*a*, 54*b*, the outer hook 46 elastically bends in the radial direction like a cantilever spring to readily provide the interference fit with minimum or no plastic deformation.

It should be recognized that without the central recess 54*d* in the outer land 54, it would not be practical to obtain the interference fit because of the substantially large interference area which would otherwise be provided over the entire outer land 54 of the forward outer hook 46 if it were not so interrupted. As shown in FIG. 4, a suitable amount of axial force F is required against the forward face of the hangers 46 to insert them in an interference fit into the mating shroud support forward slot 42. In view of the central recess 54*d* provided between the outer end pads 54*a,b* and the end recesses 52*d* adjoining the inner pad 52*a*, the interference area is limited to the suitably sized pads 52*a* and 54*a,b* themselves and at least an aft portion of the ridge 54*c* in the preferred embodiment for providing a continuous first seal with the outer wall of the forward slot 42 between both circumferential distal ends of each of the hanger forward outer hooks 46 and circumferentially along the ridge 54*c*. In this way, the bleed air 14*a* which is being conventionally channeled over the forward face 28*a* of the turbine shroud 10 is prevented from entering the joint between the hook outer land 54 and the outer land 42*a* of the forward slot 42.

As shown in FIG. 3, the central recess 54*d* may be initially formed in the outer hook 46 as part of the original casting thereof. The outer land 54 may then be conventionally machined to form the required final circumferentially arcuate configuration for mating with the circumferentially arcuate portion of the shroud support forward slot 42. As shown in FIG. 2, the pads 54*a,b* and ridge 54*c* are preferably substantially coextensive along a common radius R from the centerline axis 12 of the engine for effecting the interference fit circumferentially along the entire outer land 54 from pad 54*a* to ridge 54*c* to pad 54*b*. FIG. 2 illustrates a continuous seal along the entire outer surface of the hanger forward outer hook 46 where it contacts the shroud support forward leg 32.

Referring again to FIG. 4, the shroud support forward slot 42 is defined between radially outer and inner parallel lands 42*a* and 42*b* which are uniform or smooth both axially and circumferentially. The forward slot inner land 42*b* is also the radially outer surface of the shroud support forward hook 40*a*. Also shown in FIG. 4 is the outer land 54 of the hanger forward hook 46 being disposed in an interference fit with the outer land 42*a* of the shroud support forward slot 42 for providing one seal thereat. Similarly, the inner land 52 at the inner pad 52*a* of the hanger forward outer hook 46 is also disposed in an interference fit with the inner land 42*b* of the shroud support forward slot 42. Although the inner recesses 52*d* (see FIG. 2) prevent sealing, they nevertheless allow any flow leakage to expand to reduce the heat transfer thereof.

In an alternate embodiment, the hook inner land 52 and the slot inner land 42*b* are complementary to each other with the former being concave (without the recesses 52*d*) and the later being convex for providing uniform and smooth mating surfaces without interruption. If manufacturing tolerances result in any gaps between the outer land ridge 54*c* and the outer land 42*a* of the forward slot 42 which degrade the first seal, the second seal provided between the hook inner land 52 and the slot inner land 42*b* provides a second line of defense against leakage therepast.

Reducing or preventing this leakage around the hanger forward outer hook 46 whose forward end is directly exposed to the bleed air 14*a* is a significant factor in improving the overall performance of the turbine shroud 10 and in turn reducing variation in the tip clearance C. As shown in the various FIGURES, the bleed air 14*a* is suitably channeled around and through the turbine shroud 10 to ensure the effective cooling thereof during operation while at the same time minimizing variation in the tip clearance C. One exemplary flow path is provided by a plurality of circumferentially spaced apart inlet apertures 56 which extend from the front face of the hangers 36 below the forward outer hooks 46 thereof. These apertures 56 are specifically provided for introducing the bleed air 14*a* in a controlled manner to in turn control the thermal response of the various portions of the turbine shroud 10. However, leakage of the bleed air 14*a* around the hanger forward outer hook 46 is undesirable since it provides an unintended additional flow path which increases thermal response of the turbine shroud 10 in this region.

Since a major objective in designing turbine shrouds is to reduce their otherwise fast thermal response to better match the slower thermal response of the blades 22 and disks 24, undesirable leakage of the bleed air 14*a* should be reduced or eliminated. In analogous conventional prior art designs, leakage around a hanger forward outer hook is sealed by using an additional seal member such as a leaf seal suitably pinned to the hanger downstream of the outer hook which resiliently engages a mating surface on the shroud support. Such as seal increases the number of parts required in the turbine shroud, adds complexity thereto, and increases cost due to assembly and maintenance. The interference fit seal provided by the hanger forward outer hook 46 in accordance with the present invention eliminates otherwise required sealing parts while providing an effective seal. This has cascading benefits since undesirable bleed air leakage is eliminated which in turn improves performance of the turbine shroud 10, minimizes variation in the tip clearance C which improves the performance of the turbine and engine. And, in turn, the bleed air 14*a* actually used in cooling the turbine shroud 10 may itself be more efficiently utilized and, therefore, less bleed air 14*a* may be required in the first instance.

Referring again to FIGS. 3 and 4, the central recess 54*d* is suitably sized in its depth D, in its circumferential extent between the pads 54*a,b*, and in its axial extent from the aftmost end of the forward outer hook 46 to the ridge 54*c* to correspondingly affect the relative size of the pads 54*a,b* and the ridge 54*c* and therefore the resulting interference surface area. Excessive interference surface area requires excessive force F for effecting the interference fit. It is desirable to minimize the required force F by reducing the interference area provided by the outer land 54 of the hanger forward outer hook 46 while at the same time providing effective sealing.

Accordingly, the ridge 54*c* illustrated in FIGS. 3 and 4 may have a suitable axial width to effect the required interference fit with minimum friction for allowing complete insertion of the forward outer hook 46 into its mating shroud support forward slot 42 without undesirable insertion force F. As shown in FIG. 4, the forward leg 32 of the shroud support 28 preferably includes a leading edge chamfer 58 extending circumferentially around the entire extent of the annular shroud support 28, and extending also axially aft and radially inwardly from the forward face 28*a* of the forward leg 32 of the shroud support 28 to the outer land 42*a* at the forwardmost end of the shroud support forward slot 42. The chamfer 58 improves the ability to insert the hanger forward outer hooks 46 into the shroud support forward slot 42 during the assembly process, with the outer hooks 46 having additional chamfers at their aft distal ends if desired.

The axial extent of the outer land ridge 54*c* as shown in FIG. 4 is selected for effecting an interference fit in the shroud support forward slot 42 only axially in part along the ridge 54*c* for a predetermined axial length L. For example, the overlap length L between the aft end of the ridge 54*c* and the forward end of the outer land 42*a* at its juncture with the chamfer 58 may be between 5 and 15 mils (0.127–0.381 mm). In this way, the overlapping interference fit of these surfaces provide relatively little resistance to effecting the interference fit, thusly requiring less insertion force, while at the same time providing an effective interference sealing fit therebetween.

Since manufacturing tolerances may result in radial gaps between the ridge 54*c* and the slot outer land 42*a*, the central recess 54*d* preferably has a predetermined depth D preselected for substantially expanding any bleed air leakage past the ridge 54*c* to reduce the axial velocity thereof for in turn reducing heat transfer therefrom to reduce transient thermal response of the hanger 36 at the forward outer hook 46 in particular. For example, the depth D may be as little as about 5 mils (0.127 mm) or greater. The inner recesses 52*d* are similarly sized for the same purpose.

Accordingly, the relatively simple use of the central recess 54*d* to create the interference pads 54*a,b* and the ridge 54*c* allows an interference fit to be made between the hanger forward outer hook 46 and its mating shroud support forward slot 42 for providing an effective seal thereat. The seal improves thermal response of the turbine shroud 10 to passively control the tip clearance C. Eliminating bleed air leakage in turn reduces parasitic flow in the turbine shroud 10 which in turn increases efficiency. The integral seal effected by the outer land 54 eliminates the additional parts, complexity, weight, and cost of alternate sealing arrangements such as the leaf seal described above.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A turbine shroud hanger for supporting a turbine shroud panel radially above a plurality of turbine rotor blades for controlling tip clearance therebetween comprising:

forward and aft radially outer hooks extending axially aft and configured for axially slidingly engaging respective forward and aft slots of an annular shroud support joined to an annular outer casing;

forward and aft radially inner hooks configured for engaging respective hooks of said panel for supporting said panel above said blades;

said forward outer hook having a radially inner land and a radially outer land, said radially outer land being defined by a pair of outer pads extending circumferentially inwardly from opposite distal ends of said forward outer hook and a ridge extending circumferentially between said pads at a forward edge of said forward outer hook, with said outer land being interrupted by a central recess extending circumferentially between said pads, and fully aft from said ridge to a distal edge of said forward outer hook; and said forward outer hook has a predetermined radial height measured between said inner and outer lands thereof which is predeterminedly greater than a predetermined radial height of said shroud support forward slot so that said forward outer hook may be axially inserted into said forward slot in an interference fit therein at least in part at said pair of pads to provide a seal thereat against leakage of bleed air.

2. A hanger according to claim 1 wherein said outer pads and ridge are substantially coextensive along a common radius for effecting said interference fit circumferentially along said outer land from pad to ridge to pad.

3. A hanger according to claim 2 wherein said inner land is defined by a central inner pad disposed circumferentially between a pair of inner recesses.

4. A hanger according to claim 3 in combination with said shroud support, casing, and panel to define a turbine shroud, and wherein:

said shroud support is fixedly joined at a proximal end to said casing, and has at an opposite distal end forward and aft hooks defining said forward and aft slots and extending axially forward in engagement with said hanger forward and aft outer hooks, respectively, to mount said hanger on said shroud support; and said shroud panel has forward and aft hooks configured to engage said hanger forward and aft inner hooks for supporting said panel above said blades to control said tip clearance therebetween.

5. A turbine shroud according to claim 4 wherein:

said shroud support forward slot is defined between radially outer and inner lands, with said forward slot inner land being a radially outer surface of said shroud support forward hook; and said outer land of said hanger forward outer hook is disposed in an interference fit with said outer land of said shroud support forward slot for providing a first seal thereat, and said inner land of said hanger forward outer hook is disposed in an interference fit with said inner land of said shroud support forward slot.

6. A turbine shroud according to claim 5 further comprising a chamfer extending axially aft and radially inwardly from a forward face of said shroud support to a forwardmost end of said shroud support forward slot; and said hanger forward outer hook is disposed in an interference fit in said shroud support forward slot only axially in part along said ridge.

7. A turbine shroud according to claim 5 wherein said inner recesses have predetermined depths preselected for expanding any bleed air leakage therethrough to reduce axial velocity thereof for in turn reducing heat transfer therefrom to reduce transient thermal response of said hanger.

8. A turbine shroud according to claim 5 wherein said central recess has a predetermined depth preselected for expanding any bleed air leakage past said ridge to reduce axial velocity thereof for in turn reducing heat transfer therefrom to reduce transient thermal response of said hanger.

* * * * *